US007963261B2

(12) United States Patent
Möck et al.

(10) Patent No.: US 7,963,261 B2
(45) Date of Patent: Jun. 21, 2011

(54) VALVE DRIVE FOR AN INTERNAL COMBUSTION ENGINE

(75) Inventors: Stephan Möck, Pretzfeld (DE); Arndt Ihlemann, Höchstadt (DE)

(73) Assignee: Schaeffler KG, Herzogenaurach (DE)

( * ) Notice: Subject to any disclaimer, the term of this patent is extended or adjusted under 35 U.S.C. 154(b) by 615 days.

(21) Appl. No.: 11/988,839

(22) PCT Filed: Jun. 29, 2006

(86) PCT No.: PCT/EP2006/006292

§ 371 (c)(1),
(2), (4) Date: Jan. 24, 2008

(87) PCT Pub. No.: WO2007/009565

PCT Pub. Date: Jan. 25, 2007

(65) Prior Publication Data

US 2009/0071427 A1 Mar. 19, 2009

(30) Foreign Application Priority Data

Jul. 15, 2005 (DE) ..... 10 2005 033 018

(51) Int. Cl.
*F01L 1/18* (2006.01)

(52) U.S. Cl. ..... 123/90.39; 123/90.16; 123/90.44; 74/559

(58) Field of Classification Search ..... 123/90.16, 123/90.27, 90.31, 90.39, 90.44, 90.6; 74/559, 74/567, 569

See application file for complete search history.

(56) References Cited

U.S. PATENT DOCUMENTS

| | | | |
|---|---|---|---|
| 3,633,554 | A | 1/1972 | Nakajima |
| 6,901,893 | B1 | 6/2005 | Gumpher |

FOREIGN PATENT DOCUMENTS

| | | | |
|---|---|---|---|
| DE | 41 18 287 | A1 | 12/1992 |
| DE | 103 16 990 | A1 | 10/2004 |
| EP | 462 853 | A1 | 12/1991 |
| EP | 1 503 048 | A1 | 2/2005 |
| WO | WO 2004/083611 | | 9/2004 |
| WO | WO 2005040562 | A1 * | 5/2005 |

* cited by examiner

*Primary Examiner* — Ching Chang
(74) *Attorney, Agent, or Firm* — Charles A. Muserlian

(57) ABSTRACT

A drive valve for an internal combustion engine comprising a variable hub profile for a valve having a lever supported on a variable support point by means of a switchable support element which provides possibilities for influencing the hub profile and alternatively and cumulatively, the cam is axially displaced such that various cam paths are active on the lever.

5 Claims, 2 Drawing Sheets

VALVE DRIVE FOR AN INTERNAL COMBUSTION ENGINE

This application is a 371 of PCT/EP2006/006292 filed Jun. 29, 2006.

FIELD OF THE INVENTION

The invention relates to a valve drive for an internal combustion engine, in which an axially movable cam with two cam tracks acts on a lever which actuates a valve of the internal combustion engine.

BACKGROUND OF THE INVENTION

DE 196 11 641 C1 discloses a camshaft on which a cam, with three axially adjacent cam tracks with different lift profiles, is arranged so as to be movable axially into three latching positions. In the three latching positions, a cam follower interacts in each case with one cam track in order to actuate a gas exchange valve. A change of a cam track and therefore a change from one latching position to another latching position takes place by means of radially actuable pins which can enter into grooves which run in the peripheral direction of the cam, with the grooves having an axial component in order to bring about the axial movement of the cam.

Object of the Invention

The present invention is based on the object of proposing a valve drive with improved possibilities for influencing the lift profile while adhering to the installation space demands.

SUMMARY OF THE INVENTION

According to the invention, the object is achieved by means of the features of independent Patent Claim 1. Further embodiments of the invention can be correspondingly gathered from the features of dependent Patent Claims 2 to 6.

According to the invention, the lifting movement of a valve of an internal combustion engine, that is to say the phase position and/or the lift of said valve, is predefined as a function of the rotational angle, by a lever, in particular a (roller) cam follower or else a rocker arm. The invention is based on the knowledge that the position of an attachment point for the valve to the lever is dependent on the position of two characteristic points of the lever, specifically on the one hand the contact point of the lever against a cam track and on the other hand against a support point which forms a bearing point. According to the invention, not only one of the above-specified characteristic points is influenced but rather both characteristic points, specifically the support point of the lever on the one hand and the active cam track on the other hand, resulting in improved possibilities for a variation of the lift profile:

According to a first possibility, the support or bearing point is arranged so as to be approximately positionally fixed, while a pivoting of the lever takes place as a result of the cam. Since the cam is axially movable, so that a first cam track is active in a first axial position and a second cam track is active in a second axial position, two different lift profiles are already possible for said first possibility, which lift profiles can differ from one another with regard to the lift profile and/or the phase angle.

Corresponding to a second possibility, it is possible to obtain a superposition of two movements, specifically on the one hand as a result of the actuating movement which is obtained by means of the cam and on the other hand as a result of a movement of the support point. By suitably influencing the support point, it is possible for the lift brought about by the cam to be increased or decreased in size. Here, it is possible to use the same movement of the support point (or a different movement of the support point) in connection both with the first cam track and also with the second cam track.

For a movement of the support point, a movement is possible between different, discrete positions which are active for a plurality of rotations of the camshaft. Alternatively or in addition, a position of the support point which is variable with the rotation of the camshaft is possible, which can be given by active adjusting means or by means of passive elements.

According to one preferred embodiment of the invention, the support point is formed by a support element which is switchable with a first switching position in which the support point is fixed and a second switching position in which the support point is movable during a rotation of the camshaft. In the first switching position, therefore, substantially in the first axial position of the cam, the movement of the lever and therefore the lift profile of the valve is predefined by the first cam track, while in the second axial position, the second cam track determines the lift profile. In contrast, in the second switching position, the lift profile results from a superposition of the movements of the support point and the respectively active cam track.

In addition to the abovementioned degrees of freedom and adjustment possibilities, it is possible according to a further embodiment of the invention for the support element to have a valve play compensating element which serves not to change the lift profile but rather to compensate an undesired play.

A further embodiment of the invention is of particular significance in connection with a deactivation of the valve, in particular in connection with a cylinder shutoff. In this case, the valve should pause in its closed position. According to the invention, in order to bring about such a stationary valve despite a rotating cam, the cam which has the smallest lift is firstly selected. In addition, the support element is placed into the second switching position in which the support point is movable during a rotation of the camshaft. According to said embodiment, the support point accordingly deflects corresponding to the rotation of the cam track and its lift, so that in this case, the lever pivots about the attachment point of the valve. Said so-called "idle stroke" of the support element is dimensioned here such that, during a rotation about the associated cam track, the support point is moved by approximately the idle stroke in one direction and then back again, while the valve remains at least largely unmoved.

As a result of an idle stroke of a support element of said type being connected with an axially movable cam with cam tracks with different lifts, it is possible for the idle stroke of the support element to be reduced in relation to comparable support elements which have an idle stroke in connection with axially non-movable cams with only one cam track. This results in a reduced longitudinal extent of the support element, which can be decisively advantageous with the restricted installation conditions in the region of a cylinder head.

It is also possible according to the invention for the cam track with a relatively small lift to be operated on the one hand with the support element in the first switching position, that is to say with an approximately fixed support point, which can be suitable for example for operating the internal combustion engine with reduced power, reduced torque and/or reduced rotational speed. With the same cam track but with the support element in the second switching position, it is also possible to bring about a cylinder shutoff in a simple manner.

For a further embodiment according to the invention of the valve drive, a control device (or regulating device) is provided which acts on suitable actuators which can on the one hand influence and predefine the axial position of the cam and can on the other hand move the support element into the respective switching positions. Here, the control device and the actuators can be of any desired design, for example activated electrically, electromagnetically, hydraulically and/or by means of suitable CPUs. The activation of the actuators takes place in such a way that, in a first operating phase, the support element is fixed, while a first cam track, preferably with a large lift profile, acts in the cam. In a second operating phase, the support element is likewise fixed, while the other cam track, for example the cam track with a relatively small lift, acts in the cam. For a variation of the lift when the second cam track is active, in particular for a zero lift, it is possible in a third operating phase for the support element to be placed into the second switching position, so that in addition to the movement of the contact point between the lever and the cam track, the support point of the lever on the support element is also variable.

A particularly compact device for activating a plurality of valves can be provided in that two cams with in each case two cam tracks can be moved together, for example by virtue of the two cams being rigidly connected to one another. By means of a common movement of the cams of said type, it is possible on the one hand for the cam tracks which act at the associated valves to be correlated with one another in a particularly reliable fashion. In addition, the expenditure for the actuators for influencing the axial position of the cams can be reduced, since a separate actuator is not strictly necessary for each cam.

For roller cam followers according to the prior art which interact with non-axially movable cams with only one cam track, a cylinder shutoff or a desired reduced lift can be brought about only if the support point is movable in the range between 6 and 12 mm. By means of the superposition according to the invention of the movement of the support element on the one hand and the different cam tracks on the other hand, it is possible to use a support element which is movable only less than 5 mm, preferably 2 to 4 mm and in particular 2.5 to 3.5 mm.

BRIEF DESCRIPTION OF THE DRAWINGS

Further features of the invention can be gathered from the following description and the associated drawings in which exemplary embodiments of the invention are schematically illustrated. In the drawings.

DETAILED DESCRIPTION OF THE INVENTION

Figure 1:
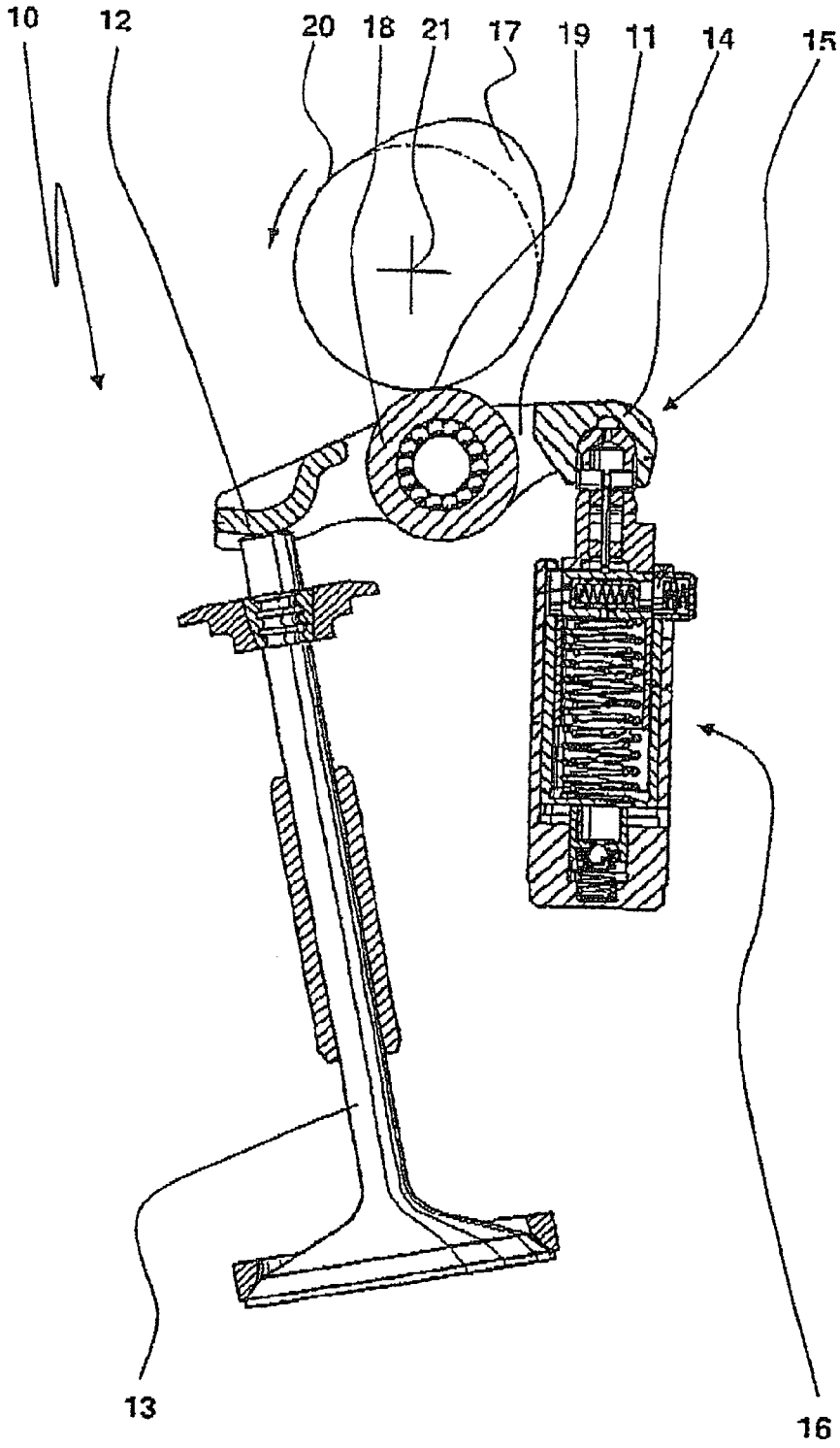
FIG. 1 shows a roller cam follower which, in an end region, actuates a valve, is operatively connected centrally to a cam track by means of a roller, and is mounted in another end region by means of a support element.

FIG. 1 shows a valve drive 10 in which a lever 11 is operatively connected in an end region 12 to a valve 13, so that the valve 13 performs an opening and closing movement according to the movement and pivoting of the lever 11. In the end region 14 opposite the end region 12, the lever 11 is supported with respect to a support element 16 at a support point 15. Between the end regions 12, 14, a cam 17 acts on the lever 11, in this case with the interposition of a roller 18. The position of the end region 12 and therefore the position of the valve 13 can be varied by means of a change in the distance of a contact point 19 of a camshaft 20 from the longitudinal axis 21 of an associated camshaft 22 and/or by means of a movement of the support point 15 as a result of a variation of the support element 16.

Figure 2:
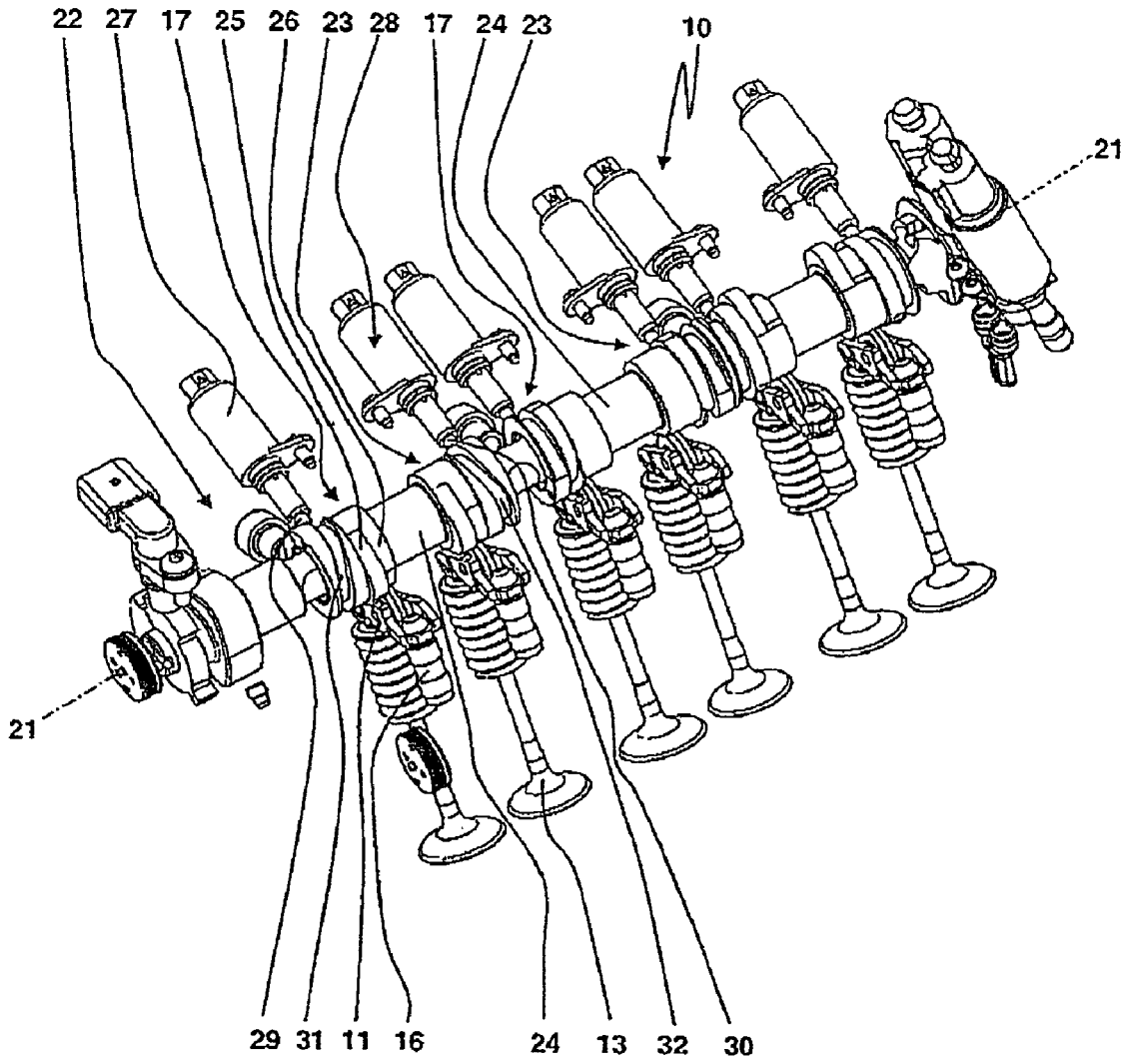
FIG. 2 shows a three-dimensional illustration of a camshaft with axially movable cams and roller cam followers which are supported by means of support elements.

FIG. 2 shows a camshaft 22 by means of which six valves 13 can be activated, of which valves in particular in each case two valves are assigned to a combustion chamber as inlet or outlet valves. Each valve is assigned in each case one lever 11 and one support element 16 corresponding to FIG. 1.

In each case two cams 17, 23 are rigidly connected to one another by means of a connecting region 24 and are axially movable in the direction of the longitudinal axis 21-21 with respect to the camshaft 22, but are connected in a form-fitting manner to said camshaft 22 in the peripheral direction. Each cam 17, 23 has a first cam track 25 and a second cam track 26, which cam tracks directly adjoin one another in the axial direction, that is to say in the direction of the longitudinal axis 21-21 and have different lift profiles, in particular different lift progressions, different maximum lifts and different phase angles.

For the axial movement of the axially movable modular unit which is formed with the cams 17, 23 and the connecting region 24, two actuators 27, 28 act on the modular units in the end regions. The actuators 27, 28 have pins 29, 30 which can be retracted and deployed transversely with respect to the longitudinal axis 21 and which, in the deployed state, can enter into guide slots or grooves 31, 32 arranged in the end regions of said modular unit, with the grooves 31, 32 not being aligned entirely in the peripheral direction, but rather being inclined slightly in the axial direction, thereby bringing about an axial lift.

In order to provide axial mobility of the cam, it is possible to use any desired design which encompasses the utilization of different cam tracks by the same lever as a result of an axial movement of the cam, of the cam track or of the camshaft itself.

Reference is made merely by way of example to the following design possibilities for the axial mobility of the cam:

- An embodiment corresponding to DE 196 11 641, as cited in the introduction, is possible, with a latching device for fixing the axial position, three adjacent cam tracks and two oppositely-running grooves in order to permit the axial lift with four radially actuated pins.
- It is likewise possible, as per DE 199 45 340 A1, for a cam track with a zero lift cam to be used. It is additionally possible according to said document for the actuator for actuating the guide pin to be integrated with the guide pin in the cam follower.
- According to DE 101 48 177 A1, it is possible to use intersecting movement grooves for different axial lift directions, into which movement grooves only a single pin is inserted for a lift in both axial directions.
- Corresponding to DE 101 48 179 A1, it is possible for a mounting of the camshaft, relative to which the modular unit is movable, to take place by means of the lateral surface of the modular unit, with the mounting in this case being designed to be an axially movable, purely radial mounting. A lateral surface between two cams of the modular unit is utilized, wherein a suitable movement travel is to be provided in the region of said lateral surface.
- In addition, it also is possible, as per DE 101 48 243 A1, for latching of the modular unit to take place in the region of the bearing, with the bearing supporting the modular unit with respect to the cylinder head.

Likewise possible, as per DE 103 30 871 A1, is the combined use of an axial adjustment of a cam with a camshaft adjuster, by means of which the phase of the camshaft can be varied, in particular in a design as a single or double internal eccentric gearing, as a swashplate mechanism, a Wolfrom gearing, a planetary gear set, a harmonic drive, a bevel gear mechanism or worm gear mechanism.

With regard to influencing the position of the support point 15, it is possible to use any desired actuators or support elements 16. Here, it is possible for the support element 16 to perform further functions in addition to a movement of the support point 15, for example to contain a valve play compensating element.

Reference is made merely by way of example to the following embodiments of a support element 16 which can be used in the invention:

According to DE 40 00 531 A1, it is possible for a spring-loaded piston which is acted on hydraulically to ensure different positions and/or movements of the support point 15 corresponding to the hydraulic state.

According to DE 199 30 573 A1, it is possible to use a support element 16 which can be set to three different lift profiles. In this case, the lever is preferably of two-part design and has two fingers. The fingers bear against different sections of the support element, with it being possible for the in each case active section to be switched by means of a switching rod. According to DE 199 30 574 A1, the fingers can interact with different cams, that is to say a large-lift cam and a small-lift cam, or else, with the present invention, with different cam tracks, so that even without axial movement by said lever, it is possible according to the switching rod for different cam tracks to be used, with it being possible for different transmission mechanisms to the valve to be selected by means of the different fingers.

According to DE 198 19 068 A1, a support element can be switched by means of an electromagnetic actuating element or by means of a rotation in such a way that either the support element is fixed or can perform a relative movement, so that no active support is provided by means of the support element.

According to DE 198 38 909 A1, it is possible for a switchable support element to ensure a zero lift in one switching position, with blocking means being used in order to prevent incorrect switches, which blocking means provide a blocking action as a function of a pivot angle of the switching lever.

DE 199 30 572 A1 discloses a switchable support element in which a longitudinally movable and rotatable switching rod is used, which switching rod interacts with a sleeve which has a coupling section and a decoupling section which bring about a switch of the support element. Accordingly, a switch can take place only when the cam which interacts with the lever is in the region of the base circle of the cam or of the cam track.

It is likewise possible for a switchable support element as per DE 100 55 014 A1 to be used, in which an outer anti-twist device and an inner anti-twist device are formed as one component.

A switchable support element with a reduced installation height and simple supply of a hydraulic means to a play compensating element results from DE 101 22 373 A1.

An improved hydraulic loading of a switchable support element can be gathered for example from DE 103 30 510 A1.

The use of materials such as glass-fibre-reinforced or carbon-fibre-reinforced plastic, in particular for a pressure piston, is known from DE 103 32 362 A1.

A further known switchable support element can be gathered from DE 102 47 949 A1.

According to the invention, a combination of the above-listed embodiments for permitting the axial mobility of a cam in order to activate two cam tracks can take place with said different embodiments for support elements.

The invention claimed is:

1. A valve drive for an internal combustion engine having a lever which opens and closes a valve and which can be pivoted with respect to a support point by a cam of a camshaft, with a) the cam being movable into a first axial position and into a second axial position, having a first cam track which acts in the first axial position and a second cam track which acts in the second axial position, and b) the support point is variable to vary the lifting movement of the valve, the support point is formed by a support element which is switchable with a first switching sition in which the support point is fixed with a second econd switchin position in which the support point is movable during a rotation of the camshaft, and c) the second cam track has a smaller lift than the first cam track and a idle stroke of the support element is dimensioned such that, during a rotation about the entire second cam track, the support point is moved by the idle stroke in one direction and then back again, while the valve remains at least unmoved.

2. The valve drive of claim 1, wherein the support element has a valve play compensating element.

3. The valve drive of claim 1 wherein a control device is provided which is connected to actuators which bring about a movement of the cam into the first and second axial positions and a movement of the support element into the first and second switching positions, with the control device being designed such that in a first operating phase, the support element is arranged in the first switching position and the cam is arranged in the first axial position, in a second operating phase, the support element is arranged in the first switching position and the cam is arranged in the second axial position, and in a third operating phase, the support element is arranged in the second switching position and the cam is arranged in the second axial position.

4. The valve drive of claim 1, wherein two cams with in each case two cam tracks can be moved together.

5. The valve drive of claim 1, wherein the support point can be moved less than five millimeters in the second switching position.

* * * * *